US006018328A

United States Patent [19]

Nolan et al.

[11] Patent Number: 6,018,328

[45] Date of Patent: Jan. 25, 2000

[54] SELF-FORMING RIB REFLECTOR

[75] Inventors: Michael Nolan, Manhattan Beach; Miguel A. Estevez, Culver City; Karl J. Sakowski, Manhattan Beach; Terry R. Denardo, San Pedro; Clarence Douglas Reddell, Hermosa Beach, all of Calif.; Russell Watkins, Felton, Pa.; John J. Sennikoff, Brea, Calif.; Patrick N. Costantini, Torrance, Calif.; Dru D. Hartranft, Redondo Beach, Calif.; Robert U. Johnson, Torrance, Calif.; Richard W. Gehle, Yorba Linda, Calif.

[73] Assignee: Hughes Electronics Corporation, Los Angeles, Calif.

[21] Appl. No.: 09/215,113

[22] Filed: Dec. 17, 1998

[51] Int. Cl.[7] ..... H01Q 15/14

[52] U.S. Cl. ..... 343/912; 343/915

[58] Field of Search ..... 343/912, 915, 343/840; 29/600, 825; H01Q 1/02, 15/16, 15/20

[56] References Cited

U.S. PATENT DOCUMENTS

| | | | |
|---|---|---|---|
| 3,438,045 | 4/1969 | Braccini | 343/912 |
| 4,455,557 | 6/1984 | Thomas | 343/912 |
| 5,446,474 | 8/1995 | Wade et al. | 343/915 |
| 5,488,383 | 1/1996 | Friedman et al. | 343/912 |
| 5,686,930 | 11/1997 | Brydon | 343/912 |
| 5,945,955 | 8/1999 | Glover et al. | 343/704 |

*Primary Examiner*—Don Wong
*Assistant Examiner*—Tho Phan
*Attorney, Agent, or Firm*—Terje Gudmestad; Georgann S. Grunebach; Michael W. Sales

[57] ABSTRACT

A single surface reflector antenna and method for making same comprises a plurality of hat-shaped cross section ribs formed on the back surface of a reflector shell with flexible tooling. All antenna shell and backing structure components are comprised of triaxial weave graphite laminate layers thereby allowing the backing structure to conform precisely to the shape of the antenna shell when cured and heat cycled.

13 Claims, 6 Drawing Sheets

SELF-FORMING RIB REFLECTOR

TECHNICAL FIELD

This invention relates generally to a single surface reflector antenna and more specifically to a single surface reflector antenna having hat cross-section ribs laid up on flexible tooling to provide for ease of manufacture and reflector surface precision.

BACKGROUND ART

Reflector antennae are widely used in a variety of radiation transmission and reception applications. High efficiency, relatively low cost, potentially low weight, and broadband capability are but a few of the advantages offered by the reflector antenna. However, for most applications the precision of the surface of a reflector antenna is crucial to the antenna's ability to efficiently direct power from a source or to concentrate transmitted energy into a narrow beam.

The quality of a reflector antenna is determined by the gain obtained for a particular aperture size. The gain efficiency of the reflector is determined by the electrical field distribution across the antenna aperture. The field distribution in turn depends upon the excitation used to generate the field and the accuracy with which the reflector conforms to the ideal surface. Thus the more accurate the reflector surface, the more efficient the gain of the antenna.

Reflector antennae are not amenable to easy local phase adjustment, as is the case with a typical phase array antenna. Indeed, an antenna positioned in space is only capable of adjustment by very complex and costly means. While it is theoretically possible to periodically (or continuously) measure the surface of a reflector and correct its shape through the use of a mechanized means, the cost and complexity required are prohibitive. There is, therefore, a need for large reflector structures having a reflector surface possessed of a high degree of dimensional accuracy and stability.

One practical approach to constructing an accurate reflector surface is to provide a surface and associated support structure possessing sufficient stiffness and stability that no unacceptable surface distortions occur during the antenna's lifetime. While fabrication of a backing structure having sufficient stiffness to adequately maintain reflector shape is relatively easily accomplished, a complex arrangement of clips, bolts and fasteners is required to secure the reflector to the backing structure. Therefore, proper adjustment of the backing structure to the reflector is a laborious and time-consuming process.

Additionally, fabrication of a reflector backing structure requires that the structure conform very accurately to the reflector back surface to avoid causing distortions in the reflector front surface and thereby reduce gain efficiency. Reflector backing structures must, therefore, be individually designed to each reflector shape in order to insure a distortion free reflector surface. Because backing structures commonly employ rib-type trusses to provide support to the reflector surface, the shape of each rib must be redesigned for each individual reflector surface configuration. For large structures with complex reflector surfaces, the redesign of the backing structure becomes a very costly and time consuming engineering task.

SUMMARY OF THE INVENTION

The instant invention overcomes the above-noted problems by providing a single surface reflector antenna having a backing structure comprised of triaxial weave graphite self-forming ribs laid up on flexible silicon mandrels. The backing structure rib configuration provides exceptional structural stiffness and rigidity while significantly reducing manufacturing costs by allowing a single backing structure design to be used for a plurality of reflector shell surface shapes.

In accordance with the present invention, a single surface reflector is provided which utilizes triaxial weave graphite laminate material for both the reflector shell and the backing structure. This configuration allows for a reflector antenna that possesses a high degree of stiffness yet is very lightweight. In addition, by providing a reflector shell comprised of multiple layers of triaxial weave graphite, no conventional reflector shell core materials are required.

Furthermore, the instant invention provides a reflector backing structure design having a triaxial weave graphite material pattern that is generic to all single surface reflectors. The size of the laminate patterns may simply be scaled to adjust for different size reflectors. The triaxial weave graphite prepreg patterns can also be cut in advance and stored until needed for reflector construction.

In one embodiment of the instant invention, a backing structure comprised of self-forming outer and radial ribs is provided that conforms to any reflector shell shape. The backing structure ribs are laid up on flexible silicon mandrels and positioned on the back surface of the shell to conform to the shape of the reflector shell prior to curing. The reflector shell and self-forming backing structure are then heat-cycled as an integral unit. This process facilitates surface correction between the backing structure and the shell and obviates the need for complex and costly assembly tooling normally required for fabrication of reflector backing structures.

In a preferred embodiment of the present invention, both radial and outer backing structure ribs have a hat-shaped cross sectional area, in contradistinction to traditional "T" section or sandwich panel ribs. The hat section ribs, laid up on flexible silicon mandrels, provide an efficient cross section that when coupled with a rib lattice section superimposed on the shell back surface, allow for exceptional dissipation of energy induced by shell snap-through without placing excessive loading on the rib to shell attachment points. This allows the use of a backing structure having fewer ribs than known in the art antenna designs, and thus a lighter overall weight. Additionally, a design that utilizes fewer structural ribs provides for less potential distortion of the reflector surface.

The self-forming hat cross section radial and outer ribs also allow the use of integral shell-to-rib angle clips spaced longitudinally along the outer edges of the ribs. The integral clips eliminate the need for hundreds of conventional fasteners and provide for greatly simplified reflector assembly. Both radial and outer ribs have scalloped cut-out areas along their lateral edges that decrease the weight of the backing structure without sacrificing structural integrity.

Therefore, one object of the present invention is to provide a lightweight single surface reflector having a backing structure comprising a plurality of self-forming ribs having hat-shaped cross sections. The ribs are formed from a triaxial weave graphite laminate material on flexible silicon mandrels that conform accurately to the shape of the rear reflector surface, thus eliminating the need for the complex tooling required for assembly of conventional reflector support structures. The efficient hat-shaped cross section provides a rib that is light in weight and exhibits excellent torsional stability. Construction of ribs from flexible material eliminates the need for specially designed tooling for each particular reflector shape, as is the case with known in the art "T" section graphite laminates or flat sandwich panel ribs.

A further object of the present invention is to provide a reflector backing structure utilizing radial and outer ribs having integral mounting clips that obviate the need for the numerous fasteners required to attach the backing structure to the shell in conventional single surface reflector designs. This results in a reflector assembly having fewer parts and more efficient assembly than with conventional reflectors.

A yet further object of the present invention is to provide a reflector having a backing structure and shell made from triaxial weave graphite laminate with integral rib lattices superimposed over the shell back surface. The rib lattices, in concert with the hat-shaped cross section ribs, allow for exceptional dissipation of energy induced by shell snap-through.

A yet further object of the present invention is to provide a method for fabrication of a single surface reflector having a reflector shell and backing structure comprised of triaxial weave graphite laminate. The reflector backing structure is fabricated directly on the rear surface of the shell, obviating the need for complex assembly tooling. Both the backing structure and shell are thermal cycled as a unit to allow for surface correction.

BRIEF DESCRIPTION OF THE DRAWINGS

FIG. 6 is an illustration of a partially constructed antenna backing structure showing both radial and outer rib lattices and radial and outer ribs.

BEST MODES FOR CARRYING OUT THE INVENTION

Figure 1:
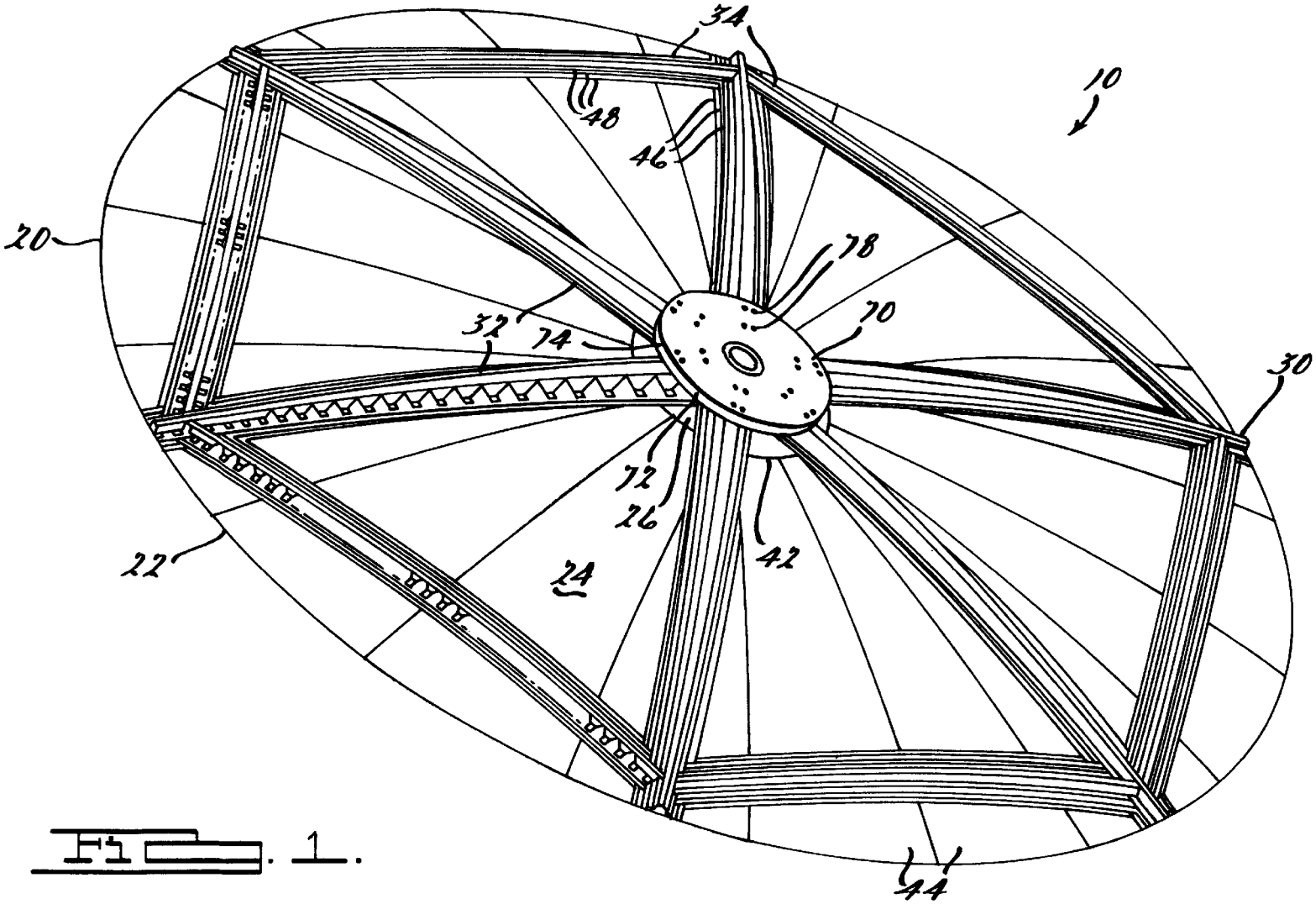
FIG. 1 is an isometric rear view of one embodiment of the instant invention.
Figure 2:
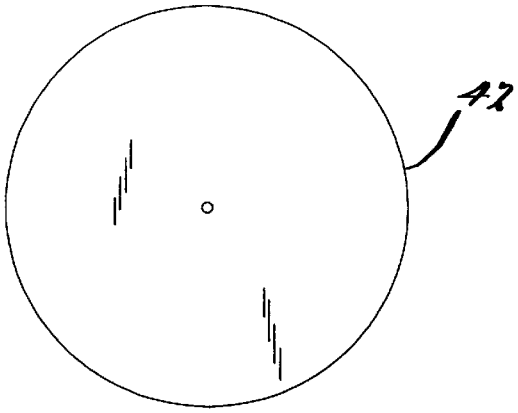
FIG. 2 is a triaxial weave graphite material center section in accordance with the instant invention.

Referring to drawing FIG. 1 and in accordance with a preferred constructed embodiment of the present invention, a single surface reflector antenna 10 has a shell 20 constructed from an epoxy impregnated triaxial weave graphite (hereinafter TWG) laminate material such as UHM/8552 Triax Prepreg, or an equivalent high modulus uncured graphite reflective material suitable for reflecting an electromagnetic wave. The shell 20 has a front (or reflector) surface 22 and a rear surface 24. An antenna backing structure 30 is provided having a plurality of TWG laminate radial ribs 32 and a plurality of TWG laminate outer ribs 34 to support and provide stiffness to the shell 20.

Fabrication of the shell 20 is accomplished by laying up multiple layers or plies of shaped TWG fabric onto a monolithic graphite mandrel having a shape that is the mirror image of the design shape of the shell 20. As shown in FIGS. 1–5, the shell 20 is comprised of a plurality of circular gores 42 forming a center section 26, a plurality of overlapping pie gores 44, and a plurality of spaced radial and outer rib lattices 46 and 48 respectively.

The center section 26 of the shell is comprised of a laminate of four circular gores 42 of TWG material. The pie gores 44 are cut from TWG fabric in the shape of radially truncated semi-circular sections of laminate material having an inner annulus that overlaps the circumference of the circular gores 42. Both the pie gores 44 and the circular gores 42 are laid up on the mandrel such that the circular gores 42 are located at the center of the mandrel and the pie gores 44 are positioned concentrically around the circular gores 42 to form a parabolic shape. In a preferred embodiment of the instant invention four TWG layers of pie gores 44 and circular gores 42 are laminated to construct the shell 20.

Figure 11:
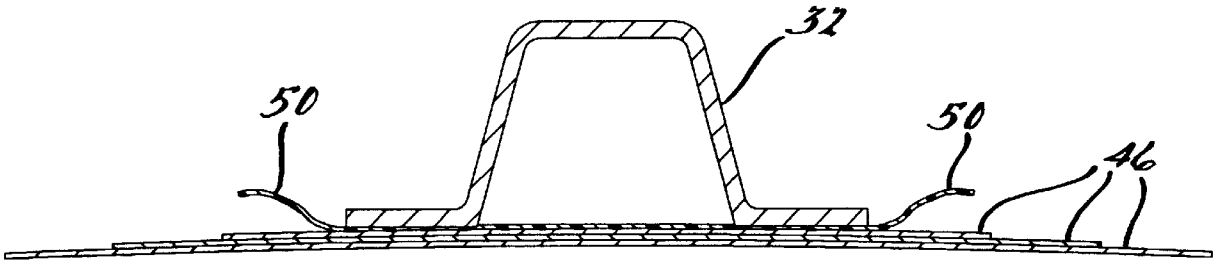
FIG. 11 is a cross-sectional view of a radial rib taken along line 11—11 of FIG. 7.

Referring to FIGS. 1, 4, 5 and 6, the shell 20 is further constructed by superimposing a plurality of TWG radial rib and outer rib lattice sections 46 and 48 respectively, over the back surface 24 of the shell 20 to reinforce the areas where the backing structure 30 will mate to the shell 20, as explained hereinbelow. The radial rib lattices 46 are comprised of a plurality of longitudinally tapered rectangular TWG fabric layers extending radially from the circular gores 42 to the outer edge of the shell 20 such that a radial lattice section 46 is wider at the center of the shell 20 than at its outer edge. In one embodiment of the instant invention, as shown in FIGS. 1,6, and 11 each succeeding four layers of TWG used to build up the radial lattice 46 are narrower than the previous four layers, thereby forming a radial lattice 46 that has a cross section of tapered thickness. In a preferred constructed embodiment of the present invention, the radial rib lattices 46 are positioned at 60 degree intervals around the plane of the shell back surface 24 and extend from the center section 26 of the shell 20 to it's outer edge.

Figure 12:
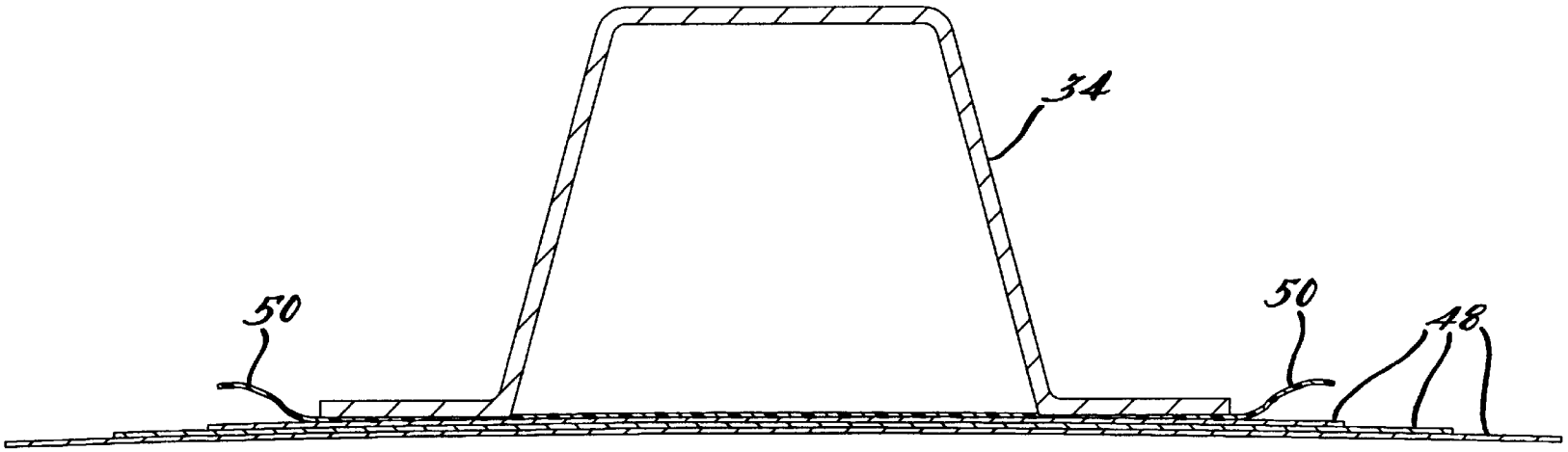
FIG. 12 is a cross-sectional view of an outer rib taken along line 12—12 of FIG. 9.

The outer rib lattices 48 are also comprised of a plurality of rectangular TWG fabric layers superimposed on the shell back surface 24. Each outer rib lattice 48 is positioned to connect the outer ends of adjacent radial rib lattices 46 around the perimeter of shell back surface 24. In a preferred embodiment of the present invention, as shown in FIGS. 1,6 and 12, each succeeding four laminate layers of TWG used to build up the outer rib lattices 48 are narrower than the previous four layers, thereby forming an outer rib lattice 48 having a tapered thickness. In a preferred constructed embodiment of the present invention, both the radial and outer rib lattices, 46 and 48, are comprised of twelve TWG laminate layers.

When the aforementioned shell 20 components are assembled in their proper positions on the mandrel, they are then heat cured by placing the shell 20 and the mandrel in an oven or alternatively utilizing mandrel heaters to transfer heat to the TWG components. The curing process transfers heat to the shell components thereby hardening the impregnated epoxy resin in the TWG material and setting the shell 20 components in the exact shape of the mandrel surface.

Referring to FIGS. 6–12, a plurality of radial ribs 32 and outer ribs 34 are laid up on flexible silicon mandrels by superimposing multiple TWG fabric layers over the mandrels. Both the radial ribs 32 and the outer ribs 34 are comprised of a plurality of TWG fabric layers. The radial ribs 32 have a hat-shaped cross section of variable depth and are longitudinally tapered such that each radial rib 32 has a greater width and cross sectional area at the end located on the center section 26 of the shell 20 than at its outer end.

Figure 7:
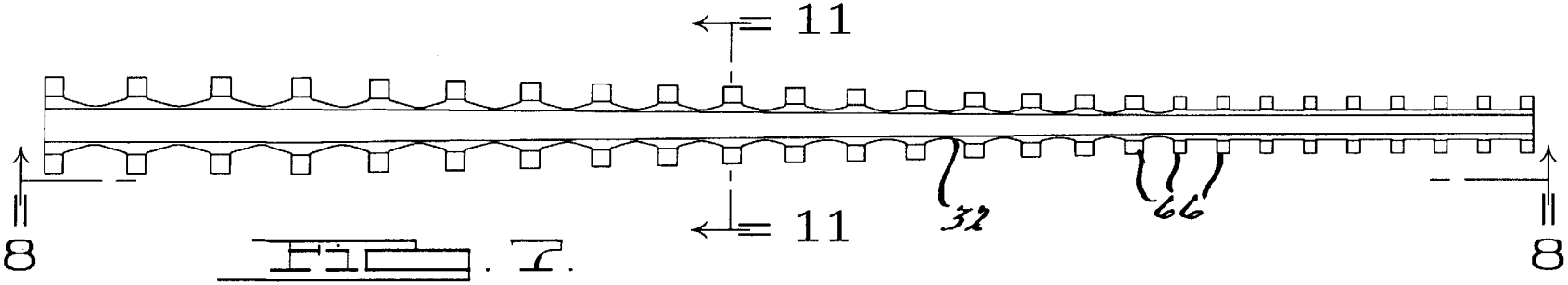
FIG. 7 is an illustration of a radial rib in accordance with the instant invention.
Figure 8:
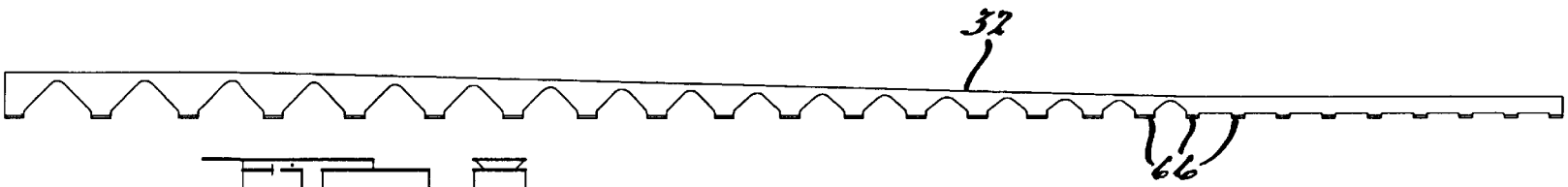
FIG. 8 is an illustration of a radial rib taken along line 8—8 of FIG. 7.

Additionally, each radial rib 32 is provided with a plurality of integral clips 66 spaced longitudinally along the lateral edges of the hat-shaped cross-section. The integral clips 66 are used to provide bonding surfaces at a plurality of locations between the radial ribs 32 and the shell back surface 24. The radial ribs 32 are laid up on flexible silicon mandrels and located on the back surface 24 of the shell 20 superimposed over the radial rib lattices 46. As shown in FIGS. 7 and 8, in a preferred constructed embodiment of the instant invention the radial ribs 32 have scalloped cut-out sections spaced along the lateral edges of the radial ribs 32 to reduce the overall weight of the backing structure.

Figure 9:
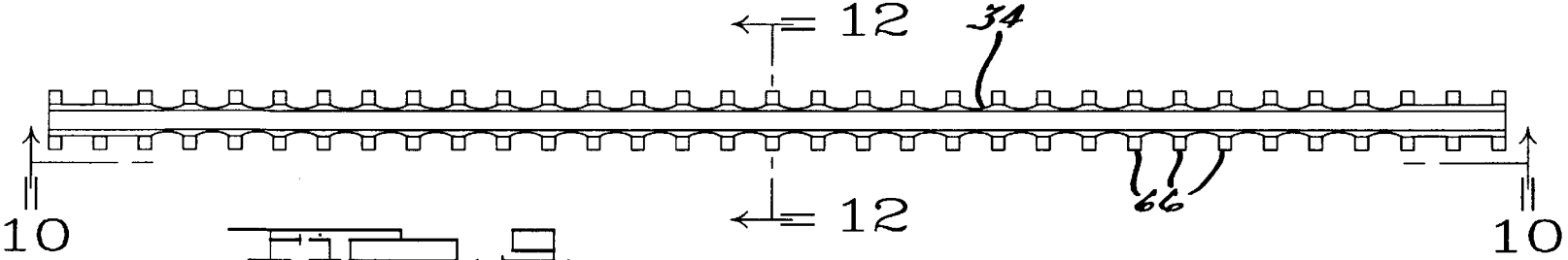
FIG. 9 is an illustration of an outer rib in accordance with the instant invention.
Figure 10:
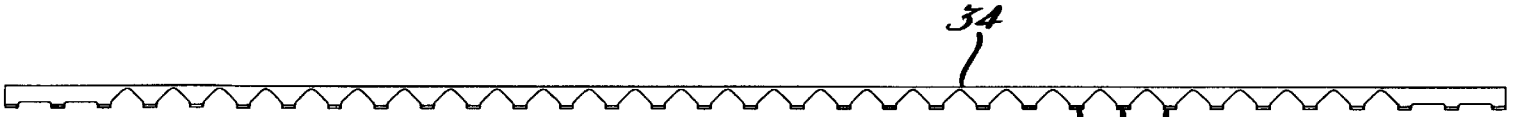
FIG. 10 is an illustration of an outer rib taken along line 10—10 of FIG. 9.

The outer ribs 34 are provided with a hat-shaped cross section of constant depth and width and a plurality of integral clips 66 spaced longitudinally along the lateral edges of the hat-shaped cross section. The integral clips 66 are used to provide bonding surfaces at a plurality of locations between the outer ribs 34 and the shell back surface 24. The outer ribs 34 are laid up on flexible silicon mandrels and located on the back surface 24 of the shell 20 superimposed over the outer rib lattices 48. As shown in FIGS. 9 and 10, in a preferred constructed embodiment of the instant invention the outer ribs 34 have scalloped cut-out sections spaced along the lateral edges of the outer ribs 34 to reduce the overall weight of the backing structure.

In one embodiment of the instant invention and as shown in FIGS. 11 & 12, a release film 50 is applied over the outer and radial rib lattices 48 and 46 prior to positioning the ribs on the lattices to facilitate removal of the backing structure 30 from the shell 20 and thereby provide for separate curing and heat cycling of each assembly. The release film 50 allows the shell 20 and the backing structure 30 to be easily separated prior to the curing process. A conformable material such as FEP (flourinated ehthylenepropylene resin) or Strechlon™ may be superimposed over the rib lattices to effect this purpose.

Figure 13:
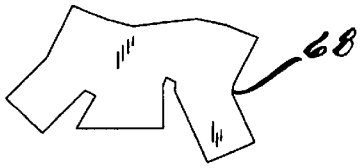
FIG. 13 is an illustration of a shear tie clip in accordance with the instant invention.

Once the radial ribs 32 and the outer ribs 34 have been properly positioned over their respective lattices, a plurality of TWG shear tie clips 68, as shown in FIG. 13, are positioned across the intersections of the radial ribs 32 and the outer ribs 34 to effect a bond therebetween. The flexible silicon mandrels used to lay up the ribs are then heated to cure the ribs, thereby stiffening the ribs in the exact shape of the shell back surface 24. Alternatively, the entire backing structure 30 and shell 20 may be heated in an oven to effect curing thereof and allow the radial ribs 32 and outer ribs 34 to conform precisely to the shape of the shell 20.

Figure 14:
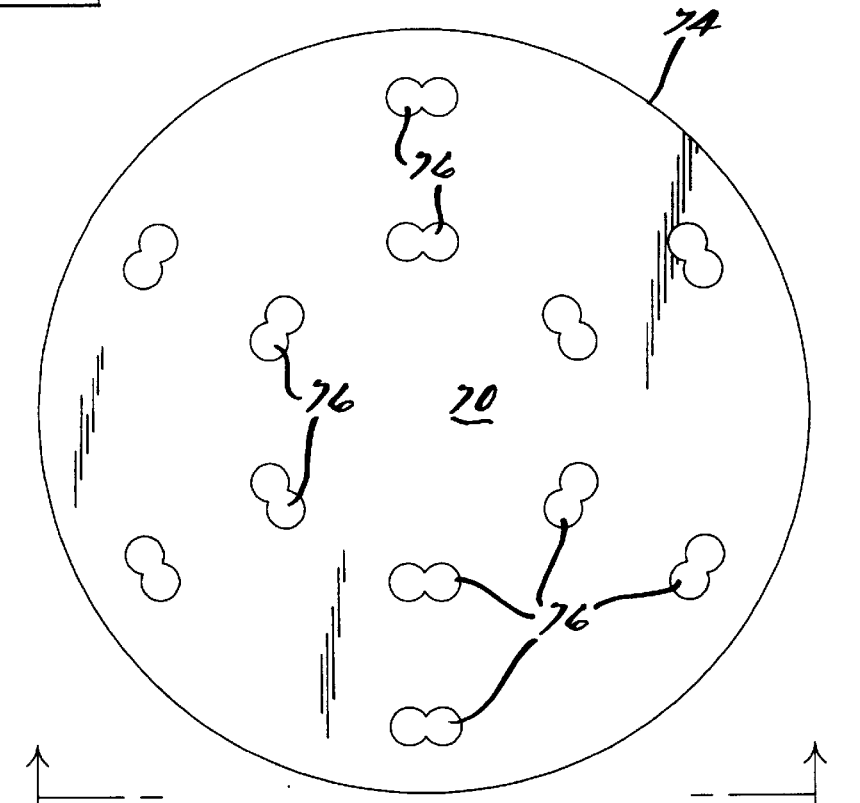
FIG. 14 is an illustration of a center hub in accordance with the instant invention.
Figure 15:
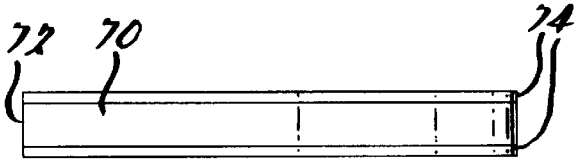
FIG. 15 is an illustration of a center hub taken along line 15—15 of FIG. 14.
Figure 3:
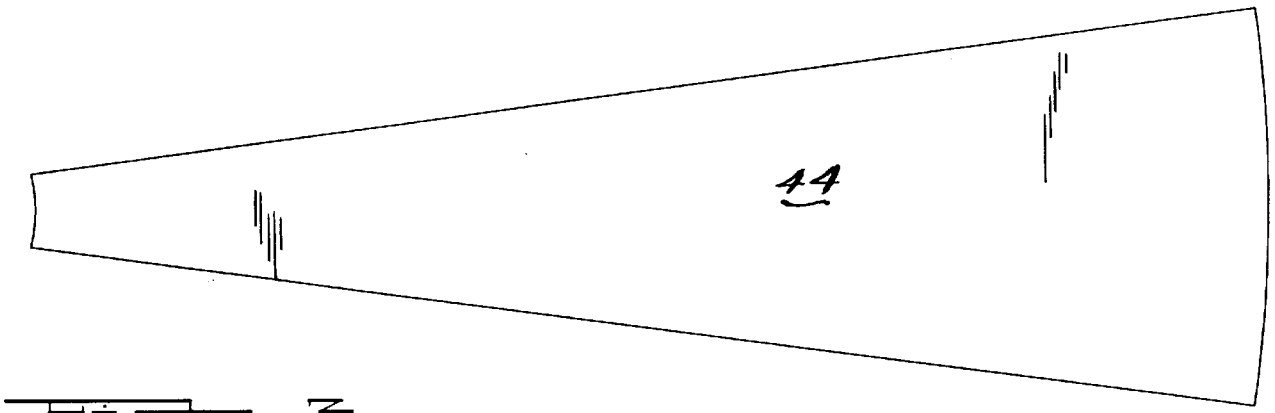
FIG. 3 is a triaxial weave graphite material pie gore in accordance with the instant invention.
Figure 4:
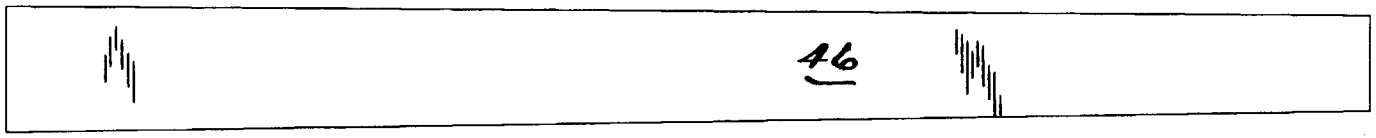
FIG. 4 is a triaxial weave graphite radial rib lattice section in accordance with the instant invention.
Figure 5:
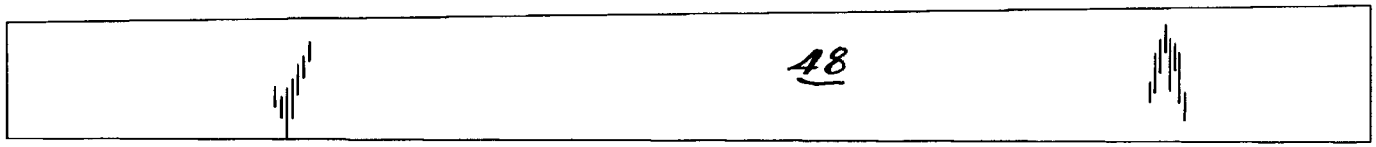
FIG. 5 is a triaxial weave graphite material outer rib lattice section in accordance with the instant invention.
Figure 5:
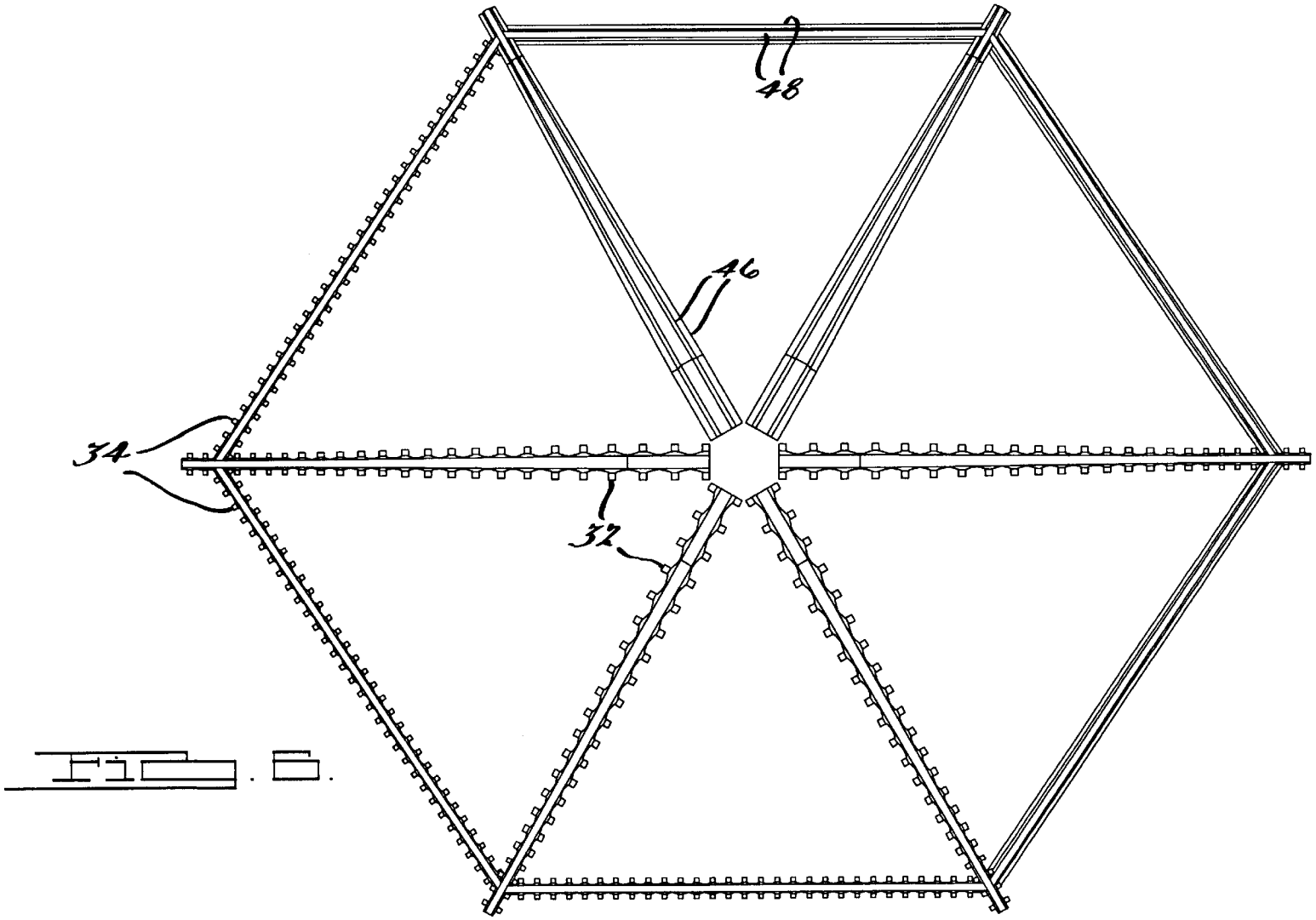

In accordance with one embodiment of the present invention, and as shown in FIGS. 1, 14, and 15, a center hub 70 comprised of a honeycomb sandwich panel 72 disposed between at least two layers of TWG facesheet 74 is provided. The honeycomb sandwich panel 72 is preferably fabricated from a material such as Korex™ or a suitable equivalent, having a plurality of spaced apertures 76 therein for securing the wide ends of the radial ribs 32 to the center hub 70. As shown in FIG. 1, the radial rib 32 wide ends may be secured to the center hub 70 with a plurality of conventional fasteners 78, such as screws, bolts or rivets, and bonded into place using a conventional epoxy adhesive.

The center hub 70 provides additional stiffness to the backing structure 30. In an alternative embodiment of the instant invention, "sacrificial" plies of TWG fabric are bonded to the outer surface of the wide ends of the radial ribs 32 in order to provide a tight fit between the rib end and the center hub 70. The "sacrificial" plies may be sanded to adjust the fit therebetween. The securing of the center hub 70 to the radial ribs 32 takes place after the assembly is cured and heat cycled as explained hereinbelow.

The shell 20 and the backing structure 30 are removed from the monolithic mandrel with the backing structure 30 acting as a support for the shell 20. The flexible silicon mandrels used to lay up the ribs are removed and the entire assembly is thermal cycled in an oven to allow the backing structure 30 to conform accurately to the shape of the shell 20 by encouraging surface correction of the entire assembly.

In accordance with the preferred constructed embodiment of the present invention the integral clips 66 on both the radial ribs 32 and the outer ribs 34 are bonded to the back surface 24 of the reflector using commercially available adhesive. The entire assembly is then covered by a flexible plastic sheeting which is sealed and evacuated. This "vacuum bagging" process facilitates surface error corrections induced in the components during the curing and thermal cycling processes and results in a shell 20 with improved surface accuracy.

As will be readily known and appreciated by one of ordinary skill in the art, a suitable fastener comprised of a strong yet lightweight material such as titanium, and adapted for use as a mounting means, may be secured to the center hub 70 to provide a means for mounting the reflector antenna 10 to a spacecraft or to a terrestrial antenna mounting structure.

While specific embodiments of the instant invention have been described in detail, those having ordinary skill in the art will appreciate that various modifications and alternatives to those details may readily be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

What is claimed is:

1. A single surface reflector antenna for transmission and reflection of electromagnetic energy comprising:

a) a triaxial weave graphite laminate reflector shell having a circular center section, a back surface and a reflector surface shaped for collimation of a beam;

b) a radial rib lattice having a plurality of longitudinally tapered segments having narrow and wide ends, each tapered segment comprised of a plurality of triaxial weave graphite material layers circumferentially spaced and extending radially on the back surface of said shell from the center section of said shell;

c) an outer rib lattice having a plurality of rectangular segments disposed about the perimeter of the back surface of said shell, each segment comprised of a plurality of triaxial weave graphite material layers extending between and overlapping adjacent radial rib lattice segment narrow ends and;

d) a triaxial weave graphite material shell backing structure comprising:

i) a plurality of longitudinally tapered radial ribs having a variable depth hat-shaped cross sectional area, wide and narrow ends, and a plurality of integral mounting clips spaced along the lateral edges of said radial ribs, said radial ribs being superimposed over said radial rib lattice such that the wide ends of said radial ribs overlap the center section of said shell;

ii) a plurality of outer ribs having a hat shaped cross sectional area and a plurality of integral mounting clips spaced along the lateral edges of said outer ribs, said outer ribs being superimposed over said outer rib lattice, and iii) a center hub fixedly secured to the wide ends of said radial ribs whereby said center hub provides stiffness to said backing structure.

2. The single surface reflector antenna of claim 1 further comprising a means for mounting said reflector antenna to a structure secured to said center hub.

3. The single surface reflector antenna of claim 1 wherein said radial ribs have scalloped lateral edges.

4. The single surface reflector antenna of claim 1 wherein said outer ribs have scalloped lateral edges.

5. The single surface reflector antenna of claim 1 wherein said radial rib lattice segments comprise a plurality of graphite material layers of decreasing width.

6. The single surface reflector antenna of claim 1 wherein said outer rib lattice segments comprise a plurality of graphite material layers of decreasing width.

7. The single surface reflector antenna of claim 1 wherein said shell is comprised of four layers of graphite material.

8. The single surface reflector antenna of claim 1 further comprising a release film interposed between said reflector shell and said backing structure to facilitate the removal of said backing structure from said shell.

9. The single surface reflector antenna of claim 1 wherein said center hub is comprised of a honeycomb sandwich panel disposed between a plurality of triaxial weave graphite layers.

10. A method for producing a single surface reflector antenna from a triaxial weave graphite laminate for transmission and reflection of electromagnetic energy which comprises:

a) forming a reflector shell comprised of triaxial weave graphite layers and having a circular center section on a shaped mandrel;

b) forming an outer rib lattice comprised of triaxial weave graphite layers around the perimeter of said shell;

c) forming a radial rib lattice comprised of triaxial weave graphite layers on said shell;

d) heating said reflector shell, said outer rib lattice, and said radial rib lattice to cure the triaxial weave graphite layers;

e) forming a plurality of radial ribs comprised of triaxial weave graphite layers on flexible mandrels and superimposing said radial ribs on the flexible mandrels over said radial rib lattice;

f) forming a plurality of outer ribs comprised of triaxial weave graphite layers on flexible mandrels and superimposing said outer ribs on the flexible mandrels over said outer rib lattice;

g) heating said radial ribs and said outer ribs in place on said shell to cure the triaxial weave graphite layers;

h) removing the flexible mandrels from said radial ribs and said outer ribs;

i) thermal cycling said shell, said outer rib lattice, said radial rib lattice, said outer ribs, and said radial ribs to facilitate surface correction and, j) bonding said radial ribs and said outer ribs to said shell.

11. A method for producing a single surface reflector antenna from a triaxial weave graphite laminate as in claim 10 further comprising applying a release film over said radial and outer rib lattices after heating said reflector shell to cure the triaxial weave graphite layers.

12. A method for forming a single surface reflector antenna from a triaxial weave graphite laminate as in claim 10 further comprising placing said antenna in a vacuum bag and evacuating said vacuum bag subsequent to bonding said radial ribs and said outer ribs to said shell.

13. A method for producing a single surface reflector antenna from a triaxial weave graphite laminate as in claim 10 further comprising securing a center hub to said radial ribs.

* * * * *